United States Patent [19]

Verhoff et al.

[11] Patent Number: 4,853,046

[45] Date of Patent: Aug. 1, 1989

[54] ION CARBURIZING

[75] Inventors: Stephen H. Verhoff, Toledo, Ohio; Garrol Tackett, Temperance, Mich.

[73] Assignee: Surface Combustion, Inc., Maumee, Ohio

[21] Appl. No.: 93,297

[22] Filed: Sep. 4, 1987

[51] Int. Cl.[4] ..... C21D 1/38

[52] U.S. Cl. ..... 148/16.5; 148/16; 204/192.35

[58] Field of Search ..... 204/192.3, 192.16, 173, 204/177, 192.33, 192.35; 148/16, 16.5, 16.6, 20.3

[56] References Cited

U.S. PATENT DOCUMENTS

| | | | |
|---|---|---|---|
| 3,260,892 | 7/1966 | Berghaus et al. | 315/306 |
| 3,437,784 | 4/1969 | Jones et al. | 219/121 |
| 3,681,662 | 8/1972 | Specha | 317/31 |
| 3,702,962 | 11/1972 | Wohr et al. | 321/14 |
| 3,914,575 | 10/1975 | Eichler | 219/121 |
| 4,130,762 | 12/1978 | Oppel | 250/531 |
| 4,193,070 | 3/1980 | Oppel | 340/650 |
| 4,227,032 | 10/1980 | Jones et al. | 13/20 |
| 4,246,434 | 1/1981 | Gunther et al. | 13/20 |
| 4,331,856 | 5/1982 | D'Antonio | 219/121 |
| 4,490,190 | 12/1984 | Speri | 148/16.6 |
| 4,587,458 | 11/1978 | Jones et al. | 266/88 |

FOREIGN PATENT DOCUMENTS 1255321 12/1971 United Kingdom .

OTHER PUBLICATIONS pp. A72–A75 of the Mar., 1986 issue of *Industrial Heating* article entitled "Greater Uniformity of Plasma Carburizing Rapidly", by Stephen H. Verhoff.

*Primary Examiner*—John F. Niebling
*Assistant Examiner*—William T. Leader
*Attorney, Agent, or Firm*—Body, Vickers & Daniels

[57] ABSTRACT

A heat treat process is disclosed for use in an ion glow discharge chamber for carburizing ferrous workpieces. The process provides rapid carburizing cycles by optimizing the power supplied to the glow discharge correlated to temperature and desired uniformity of the carbon gradient profile while also optimizing the mass flow of the substantially pure carbon bearing gas which is correlated to the desired uniformity of the carbon gradient profile.

13 Claims, 3 Drawing Sheets

ION CARBURIZING

BACKGROUND OF THE INVENTION

This invention relates generally to a heat treat process and more particularly to a carburizing heat treat process using ions in a gaseous atmosphere to bombard the surface of a ferrous workpiece to achieve a carburized case surface.

The invention is thus particularly applicable to carburizing by means of a glow discharge technique in a vacuum and will be discussed with particular reference thereto. However, the invention may have broader application in that it may be utilized in any ion glow discharge treatment process where the gaseous atmosphere has high electrically conductive characteristics such as that which may be encountered in boronizing and certain metal plating processes.

Carburizing the case of a ferrous workpiece has traditionally been accomplished by either atmosphere or vacuum heat treat furnaces. Generally, atmosphere furnaces can perform a wide variety of heat treat processes but cannot achieve the dimensional tolerance control that vacuum furnaces provide in carburizing ferrous workpieces. When carburizing is performed in either a vacuum or atmosphere furnace, a carrier or inert gas is mixed with a carbon bearing gas, such as methane or propane, which disassociates at high temperatures to diffuse carbon into the case of the workpiece to give the surface a hard, toughened wear characteristic. The presence of a carrier gas, in and of itself increases the cost of the process and tends to increase the overall processing time to a greater value than that which might otherwise be possible.

For a number of years, principles related to the ionization of gases have been used in a vacuum chamber with a DC current established between the workpiece cathode and the vacuum chamber anode to cause an ionic bombardment of the workpiece's surface by a disassociated ammonia gas to produce an iron nitride case on the workpiece. Use of such "glow discharge technique" has proven commercially superior to vacuum and atmosphere furnaces when performing nitriding heat treating processes. Demonstrated advantages include closer dimensional control of the workpiece and the fact that irregular surfaces on the workpiece, such as blind holes, can be uniformly treated with a nitride case. Similar advantages, albeit perhaps not as significant, are expected and have been realized in an ion carburizing process.

Recently, a number of attempts have been made to commercially use the "glow discharge technique" for carburizing ferrous workpieces with varying degrees of success. The problem uniformly encountered on a commercial basis can be defined as consistency. That is, almost any given geometrical configuration of a single workpiece can be carburized utilizing conventional glow discharge apparatus and processes. However, when a wide variety of parts must be treated over the life of the furnace and the parts are simply placed in a basket within the furnace it has not been possible to consistently carburize the parts despite the successful history of the glow discharge technique in nitriding and despite the numerous publications covering the glow discharge process, most of which simply treat the nitriding and carburizing processes as identical for glow discharge purposes. There are several problems which have been encountered. One significant problem encountered in ion carburizing (as well as in all ionizing processes) is that of "fireballs". A fireball occurs when the glow discharge seam runs amok and results in a ball of fire positioned over some discrete area of the workpiece. More specifically, a fireball is attributed to a localized arc which does not short circuit the system. Thus normal electrical controls which would otherwise sense arcing about the entire workpiece to produce a short circuit are ineffective to control the fireball phenomenon. Other significant problems encountered in ion carburizing relate to the inability to achieve a consistently uniform carbon case and the inability to achieve reasonably fast processing times.

The problem of arcing or fireballs is particularly acute in carburizing, because the carburizing gas upon disassociation produces an atmosphere which is electrically conductive while the atmosphere produced in nitriding from disassociated ammonia is electrically non-conductive. To minimize arcing tendencies associated with the use of such electrically conductive atmosphere, current attempts to ion carburize ferrous workpieces dilute the carbon bearing gas (methane, propane, etc.) with an inert, electrically nonconductive carrier gas (hydrogen, nitrogen, etc.). While the arcing tendency attributed to the atmosphere is thus reduced, the time for the process to achieve carburization is increased because both carbon bearing and non-carbon bearing gases must be ionized.

All glow discharge furnaces utilize some mechanism for controlling the current to avoid localized arcing which produces fireballs. In one commercially successful nitriding glow discharge process, the current is interrupted whenever (i) the current exceeds a predetermined value, or (ii) whenever the voltage change over a time change exceeds a certain predetermined value, or (iii) whenever the voltage change with respect to the current change over a timed increment exceeds a predetermined value Another approach, such as disclosed in U.S. Pat. No. 4,490,190 to Speri, uses a pulsed current, produced by an interruptor circuit from either direct current or rectified single or multiphase alternating current, without any additional arc control to produce the glow discharge. In the pulsed current approach of Speri, which uses an alternate source of heat such as disclosed in U.S. Pat. No. 4,124,199 to Jones to heat the workpiece, the pulsed current per se, is viewed as sufficient to prevent arcing or fireballing of the workpiece and the wattage of the power source is simply increased until the glow discharge is produced. Still another approach, disclosed in U.S. Pat. No. 4,331,856 to D'Antonio, used in a nitriding process to control arcing is to use a comparator circuit to measure the workpiece temperature and change thereof and when the change or temperature limits are exceeded the glow current is stopped. Another approach at controlling the current is disclosed in U.S. Pat. No. 4,587,458 to Davenport et al where a third dummy electrode is used to control the current actually imparted to the workpiece.

In using a vacuum, glow discharge heat treating furnace for commercially carburizing workpieces in a basket, whether of the same or dissimilar configuration in a batch mode, none of the existing processes including those described above has proven satisfactory. The processing time for carburizing was excessive when compared to the processing time of conventional vacuum furnaces, or the fireballing or arcing phenomenon prevented the process from going forward or required the power to the vessel to be reduced to a lower level than that which is otherwise available to reduce arcing or fireballs so that the time for processing is extended so as to be unsatisfactory from a commercial viewpoint or the carburized case depth was not uniform. This conclusion was reached after the traditional parameters related to controlling ion processes (as cited) along with traditional parameters such as flow rate, pressures and temperatures which are considered in vacuum and atmosphere carburizing processes were varied, mixed and matched in an attempt to produce a successful commercial ion carburizing process.

BRIEF SUMMARY OF THE INVENTION

Accordingly, it is one of the major features of the invention to optimize the heat treat time for carburizing a ferrous workpiece by use of a glow discharge technique that consistently achieves uniform carburized case depths of the workpiece in the shortest possible processing time.

This object, along with other features of the invention, is achieved in a process which controls the case carburizing of a ferrous workpiece by the ion discharge of a carbon bearing gas. Initially, the workpiece is heated by external means under a vacuum in a chamber to a temperature whereat carburizing can occur. When the workpiece is at the carburizing temperature, a DC pulsed current at a predetermined voltage is applied between the workpiece as a cathode and the chamber as an anode in the presence of a non-carbon bearing ionizable gas (i.e. hydrogen) at a predetermined vacuum level whereby the surface of the workpiece is cleansed. Once clean, the power is significantly dropped while the non-carbon bearing gas is evacuated or pumped from the chamber and a gas principally comprising a carbon bearing gas is supplied to the chamber. This changeover is done by an electrically operated solenoid valve. When the change-over of substituted gases is substantially complete, which usually occurs within 30 seconds to two minutes. The DC pulsed current is increased in wattage until carburizing (except for any boost diffusion cycle) is complete. The wattage is maximized and is expressed in units of density (i.e. watts per square centimeter of surface area to be carburized) which is correlated to the carburizing temperature and further correlated to the flow rate of the carbon bearing gas. By thus maximizing and correlating the temperature, wattage and mass flow, a substantially pure hydrocarbon gas can be used to efficiently carburize a wide variety of dissimilar workpieces with excellent case uniformity in a batch furnace on a commercially consistent basis.

In accordance with a more specific object of the invention, the watt density is a function of the temperature at which the carburizing takes place, typically 1700°–1900° F. Also, the watt density is affected by the density of the workpieces packed in the basket differently configured workpieces within the same basket. Generally the watt density increases as the temperature is increased and is adjusted upwards for loosely packed workpieces to maintain a consistently uniform carburized case within tight limits at a minimum processing time.

In accordance with another particularly important aspect of the invention, the uniformity of the carbon penetration into the surface case of the ferrous workpiece is additionally controlled by the mass flow coefficient of the carbon bearing gas in the work chamber. More specifically, it is critical that the carbon case be uniformly applied and both the mass flow of the carburizing gas and the power supplied to the glow discharge must be controlled to achieve the uniform case depth.

In accordance with still another feature of the invention, a conventional maximum current shut-off circuit is used in conjunction with the pulsed current to interrupt the pulsed current when its value exceeds a predetermined limit as a safeguard against localized arcing within the chamber which in combination with the process control variables cited permits the invention to achieve the desired consistent results.

It is thus a further object of the invention to provide a process where a minimum amount of carbon bearing gas is utilized with an attendant minimal amount of sooting to achieve case carburizing of the ferrous workpiece by an ion glow discharge process.

It is another object of the invention to provide an ion glow discharge process for carburizing ferrous workpieces whereby a minimum amount of carbon soot is deposited within the glow chamber and conversely, a maximum amount of carbon is diffused into the case of the ferrous workpiece so that the down-time of the furnace for cleaning purposes is minimized.

Yet another object of the invention is to provide an ion glow discharge process for carburizing ferrous workpieces which minimizes the process time to effect the carburizing process.

Still a further object of the invention is to provide a process for controlling ion carburizing of a ferrous workpiece whereby the carbon gradient profile of the carburized case is consistently and uniformly maintained not only at the surface of the workpiece but also below the surface of the workpiece.

A still further object of the invention is to provide an ion glow discharge process for carburizing a variety of ferrous workpieces which permits consistent and reliable carburized cases to be applied to the workpieces.

A more general object is to provide an optimum ion control process for use in an atmosphere which is highly electrically conductive.

The invention may take physical form in certain parts and arrangement of parts a preferred embodiment of which will be described in detail and illustrated in the accompanying drawings which form a part hereof and wherein.

DESCRIPTION OF THE PREFERRED EMBODIMENT

Figure 1:
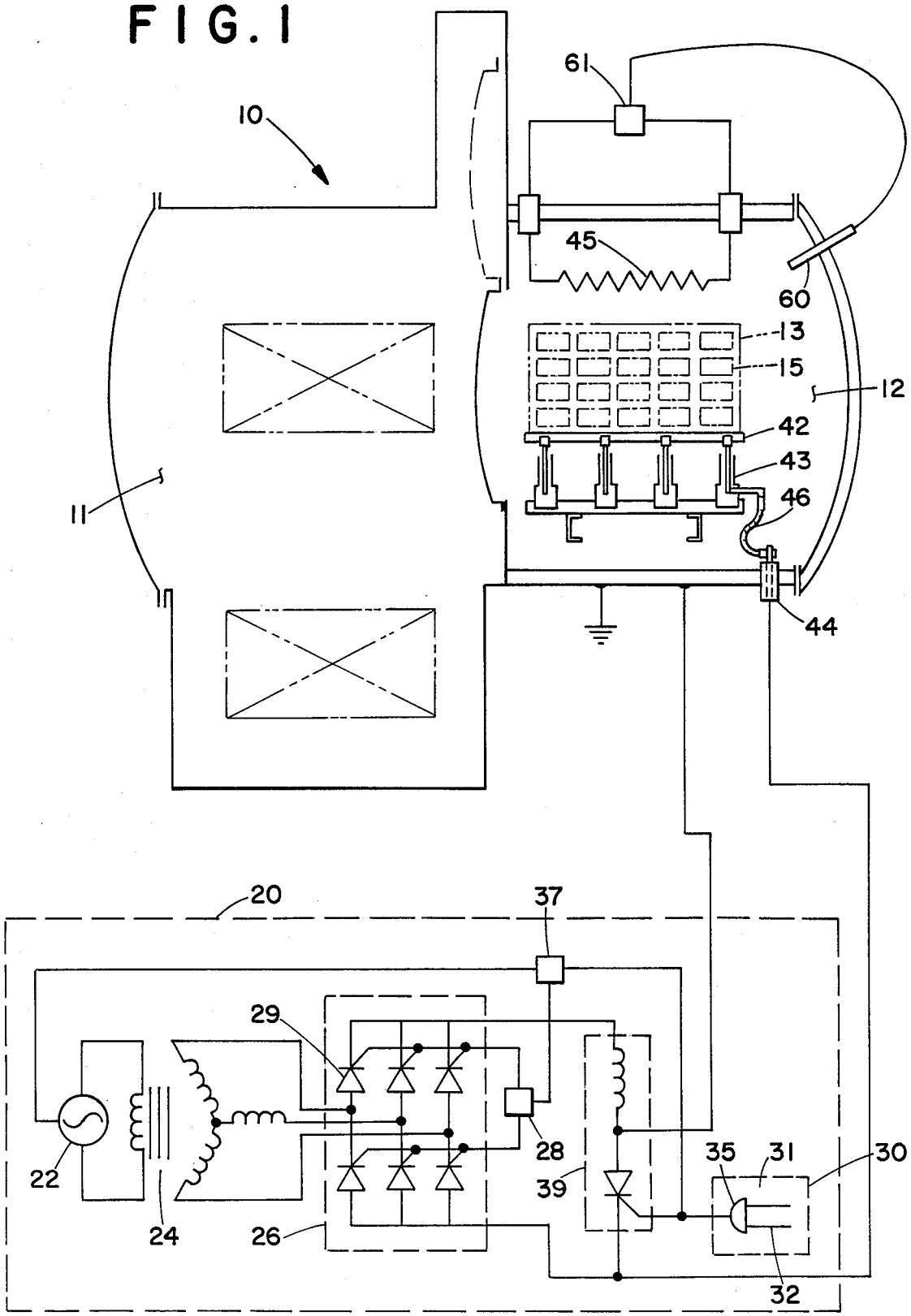
FIG. 1 is a schematic diagram illustrating the power supply of the invention.

Referring now to the drawings wherein the showings are for the purpose of illustrating a preferred embodiment of the invention and not for the purpose of limiting the same, there is shown in FIG. 1 a vacuum vessel 10, defined for purposes of the preferred embodiment as a single vacuum chamber 12 containing a basket 13 which is loaded with a plurality of ferrous workpieces 15. As is conventional in the glow discharge art, vessel 10 is the anode while ferrous workpieces 15 comprise the cathode.

For convenience, a number of different terminology related to plasma arc heating are used throughout the specifications. To avoid any confusion in this regard, the following definitions are used for such terminology. "Short Circuit" means a physical connection between the two electrodes (anode + and cathode −) by an electrically conductive material such as a metal or carbon resulting in zero or little voltage potential and high to infinite current flow. "Arc Condition" or "arcing" means an electrical connection between the two electrodes (anode and cathode) by an ionized gas with a low voltage (less than 100 VDC) and high current (greater than 20 amperes) travelling along the free electron path created by the ionized gas. Visible by a lightning bolt appearance. "Glow Discharge" means an equal concentration of free ions and free electrons resulting in atoms forming in an excited state. The energy released when the atom forms is given off as visible light or glow. The voltage is from 400 to 2000 VDC and the current can be any value from milliampers to hundreds of ampers. "Fireballing" means a glow discharge state in which an anomaly occurs in a localized area such that this localized area has a higher current flow per unit area than anywhere else in the glow discharge. This localized area starts to overheat resulting in electrons being cooked off that results in even higher current draw in this localized area. This cascades into an "arc condition" but after it is too late because the part may have already been damaged from the localized overheating. It should be noted that this occurs on any geometry electrode—flat surfaces, round surfaces, cavities, etc. "Hollow Cathode" means a localized condition of overheating from the glow discharge that only occurs in a cavity (can occur in any hole depth having any L/D ratio where L equals the depth of the hole and D equals the hole diameter) and is a function of the operating pressure. The glow discharge thickness is a function of the absolute pressure. In a cavity at certain pressures, the glow discharge along the walls overlap with the glow discharge on the opposite wall. This overlapping causes a cascade increase in the electron density and as a result, an increase in the current density in the cavity. As a result, the cavity overheats.

Power supply 20 is illustrated as an AC to DC rectified power supply and essentially includes a 3-phase generator 22 connected to a stepped-up transformer 24, which in turn is connected to an SCR circuit 26 controlled by a firing circuit 28 to produce a pulsed current applied to anode 10 at various power levels. SCR circuit 26 is shown to comprise 6 thyristors 29 whose gates are connected to a conventionally known firing circuit schematically shown at 28. Firing circuit 28 controls thyristors 29 to preferably produce 5 "on" pulses of rectified DC current followed by 2 "off" pulses although other firing arrangements such as four "on" and three "off" are possible. Reference may be had to U.S. Pat. No. 3,702,962 to Wohr et al for a more detailed explanation of an SCR circuit and a firing circuit somewhat similar to that disclosed in FIG. 1. Reference may also be had to U.S. Pat. No. 3,914,575 for an arrangement generally similar to that shown in FIG. 1.

Figure 2:
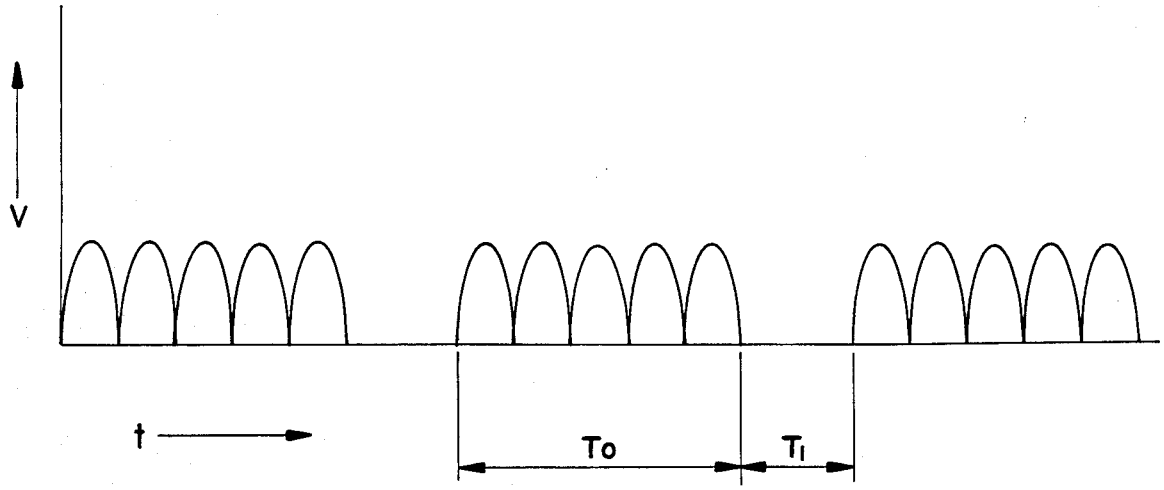
FIG. 2 is a graph of the pulsed DC current applied to the anode and cathode of the chamber.

As described thus far the pulsed current applied to vessel 10 is best shown in FIG. 2. Preferably the "on" cycle, $t_O$, of five pulses is 13.89 milliseconds with a range between 8.33 and 16.67 milliseconds and the "off" cycle, $t_1$, is 5.56 milliseconds, with a range between 2.78 and 11.11 milliseconds. The current is variable between 10% and 100% of rated power but preferably is 50% of amps at full watt density. Voltage varies between 300 and 1000 peak volts.

Firing circuit 28 is also controlled by a conventional $I_{Max}$ circuit 30 which senses the current draw and shuts down firing circuit 28 when the current exceeds a predetermined maximum value, typically 115% of rated amps. Control circuit 30 senses the actual current draw at 31, compares it to the predetermined maximum current at line 32 through comparator 35 to shut down firing circuit Z8 when the actual current draw exceeds $I_{Max}$. At such time comparator 35 also triggers smoothing choke shown schematically at 39 to dissipate the electrical energy. The number of times control circuit 30 is actuated over a fixed time is counted by a conventional counter shown at 37 which, when actuated, prevents severe arcing by shutting off generator 22 and firing circuit 28.

Figure 3:
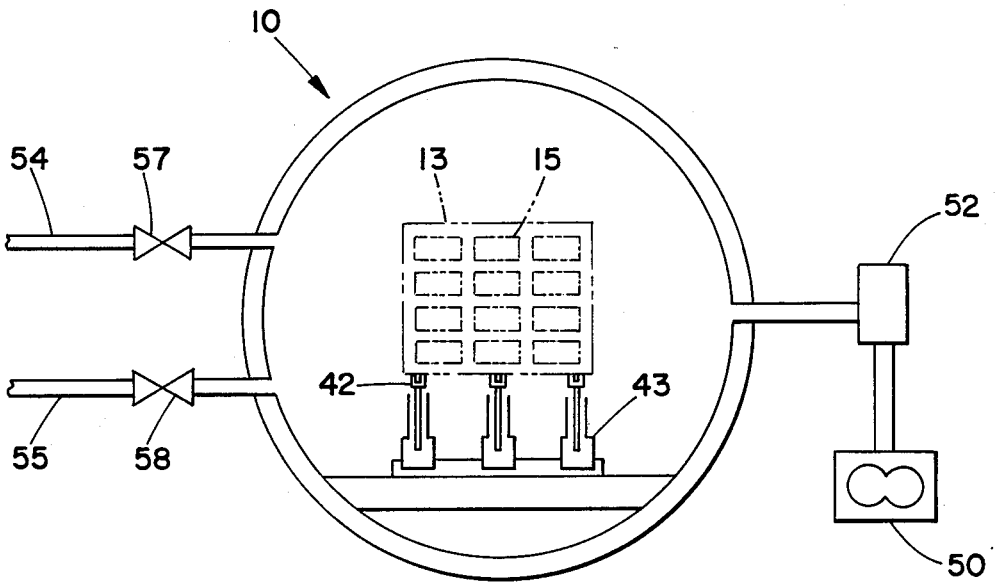
FIG. 3 is a schematic diagram of the vacuum ion carburizing vessel used in the invention.

While a three phase generator 22 is preferred, it should be clear that other power supply arrangements can be used, such as direct current or single phase alternating current, to effect the desired pulsed current to vessel 10. The operating characteristics of one suitable power supply 22 may be summarized as follows:

AC input: 480 VAC±5%, 3 phase 60 Hz
Full power output: Up to 360 KW
Open circuit voltage: 1000 volts capable of 360 amp drive circuit
Max. full load voltage: 700 volts
Max. full load current: 100% of rated amperage
Output current: adjustable 10 to 100%
Output voltage: adjustable 10 to 1000 volts Vessel 10 as shown in FIGS. 1 and 3 comprises a multiple chamber, batch type vacuum vessel with an integral oil quench 11 which has been modified to carry on the ion discharge process. A hearth 42 manufactured from molybdenum supports basket 13 containing ferrous workpieces 15 and insulators 43 support and shield hearth 42 from vessel 10 while also providing connections for feed-thru's 44 and a high dielectric shielded cable 46 for connecting the hearth, basket, and work pieces as the cathode to power supply 20. Reference may be had to U.S. Pat. No. 4,246,434 to Gunther et al and U.S. Pat. No. 4,227,032 to Jones et al for description of typical insulators, feed-thru's, splitters, etc. Also schematically shown within vessel 10 is an external resistance heater 45 for providing a source of external heat to workpieces 15. Heater 45 is preferably of the type manufactured by the assignee under the trademark "PROLECTRIC" with or without graphite tubes or alternatively could assume an especially configured shape such as illustrated in U.S. Pat. No. 4,124,199 to Jones. A vacuum pump 50 is shown schematically and is sized to pump a vacuum of 10 to 15 microns. Between vacuum pump 50 and chamber 12 is a needle valve 52 which functions as an orifice to control the vacuum applied to chamber 12 and hence the flow of inert or carburizing gases through lines 54, 55 respectively. Needle valve 52 is a very precise metering type of a conventional design. Lines 54, 55 are normally at 20 psi and have manually controlled valves 57, 58 respectively installed therein but in operation are normally opened so that if needle valve 52 was not present a constant mass flow of gas would be emitted therefrom with an attendant rise in pressure. Vacuum pump 50 and needle valve 52 are sized large enough to draw a vacuum in chamber 12 when the gases in lines 54, 55 are at the stated flow rates and pressures.

The typical carburizing cycle will now be explained.

The basic carburizing cycle with workpieces 15 in basket 13 is to pump down chamber 12 to a low vacuum level of approximately $10^{-2}$ to $10^{-1}$ torr and then heat workpieces 15 by external resistance heater 45 to proper carburizing temperature which is anywhere between 1650°-1950° F. An inert gas, preferably hydrogen, is then introduced at a constant mass flow through inlet 54 with the variable orifice of needle valve 52 controlling the pressure within chamber 12 between 1 and 25 torr. Power supply 20 is then activated at a predetermined power level to effect the glow discharge about workpieces 15 which will sputter clean the exterior surfaces of workpieces 15. In particular, oxides will be removed from the surface of workpieces 13 and the oxides will combine and form $H_2O$ and $CO_2$ within the atmosphere in glow chamber 12 which is pumped out of channel 12 vis-a-vis vacuum pump 50 through needle valve 52. While the glow discharge tends to heat workpieces 15 the heat applied to workpieces 15 is principally from the external resistance heaters 45 which remain on throughout the process and are regulated through a temperature sensing device 60 which senses the temperature of the atmosphere in chamber 12 and not the work and which then is inputted into a microprocessor 61 which controls electric resistance heaters 45 during the entire process. Once the sputtering or slight arcing at the workpiece surface has burned off the contaminants on the workpiece surface, a glow discharge will be established. Thus, once the glow discharge is established, the ferrous workpieces are ready for carburizing.

The fundamental difference between nitriding and carburizing is that the disassociated ammonia gas in nitriding produces an electrically non-conductive atmosphere whereas the exact opposite is produced in carburizing where methane or propane disassociates itself into a carbon bearing atmosphere. More particularly, the carbon bearing atmosphere in carburizing has a dielectric (arc-over) distance of 2 inches at 500 volts and 500 microns pressure on flat plate electrodes while a nitrogen atmosphere has a dielectric distance of 5 millimeters at 500 volts and 500 microns. This means an arc will occur between electrodes spaced 2 inches apart in the carburizing atmosphere whereas the electrodes must be moved to within 5 millimeters of one another to sustain an arc therebetween in the nitriding atmosphere. Accordingly, all conventional carburizing processes which use various glow discharge techniques, utilize a carburizing gas mixed with an inert or carrier gas to effect the carburizing. However, the carrier gas materially increases the time to effect carburizing since a lesser volume of carbon is available at any given instant to interfuse into the case and this means that the glow discharge must be left on for a longer period of time. In addition, a complicated and thorough mixing of the carrier gas with the carburizing bearing gas must be accomplished prior to admitting the gas into the furnace so that no particular concentration of the carburizing gas could somehow be localized near the work to form a severe arc or fireball. (It should also be noted that in conventional vacuum carburizing one process pulses a stream of methane into the furnace. This dilutes or increases the carbon concentration of the carrier gas which is within the furnace. The point is that such a process would be totally unsuitable for ion carburizing because of excessive sooting and the unstable atmosphere formed by the pulsing which would produce arcing.)

In accordance with the invention, a pure carbon bearing gas such as methane or propane is introduced into chamber 12 once the part has been sputtered clean. It was found that when methane was immediately introduced into chamber 12 upon completion of sputter cleaning, severe arcs would form because the atmosphere was unstable. An obvious solution would be to pump the hydrogen completely out of the chamber before admitting the methane into the chamber. While this would prevent arcing, it is commercially unfeasible from a time consideration. It has been found that if the current flow were reduced to a value of approximately 10 amps for about 2 to 3 minutes after the hydrogen flow was stopped and the methane flow started, a sufficiently stable atmosphere was present which would permit the application of approximately the same watt density power to workpieces 15 as was used during the sputter cleaning process. In this connection the metering arrangement utilized by needle valve 52 is particularly advantageous since the pressure from the pump is used to effect the gas changeover while also updating the mass flow of the gas into chamber 12.

At this time, the power applied between the anode and cathode is set at a predetermined optimum level which will be discussed hereafter. This power expressed as a watt density level is sufficient to form the glow discharge with almost all the carbon molecules infused into the case of workpieces 15. Tests measuring the weight of the carbon show that no less than 85% of the carbon is diffused into the case leaving at most 15% of the carbon to be deposited as soot within chamber 12. This naturally extends the time before the furnace has be to cleaned or subjected to a high burn-out temperature cleansing cycle. At the same time, the mass flow of the methane is closely controlled so that only a fixed amount of carbon is available for diffusion into the case. When the watt density and the mass flow are thus controlled, a surprisingly consistently uniform dispersion of the carbon about the entire case of workpiece 15 is achieved. This consistent carbon dispersion extends uniformly into the case making more metal available for wear purposes at a higher hardness after surface finishing than that which was otherwise attained with conventional vacuum carburizing or atmosphere furnaces. As will also be noted hereafter, the temperature of workpiece 15 affects the watt density but not the mass flow of the carburizing gas. The pressure during this cycle is not critical so long as the pressure is less than atmosphere and sufficient to permit the glow discharge process to work. In practice, generating the glow discharge is a function of voltage and for the 1000 volt generator illustrated the pressure is limited from 10 microns to 100 torr. Typical pressures during this portion of the cycle are 1 to 25 torr with 5 torr preferred. This is to be contrasted with typical pressures of 100 to 400 torr used in conventional vacuum carburizing furnaces. Also, the temperature of workpiece 15 is not adversely affected or purposefully controlled by the glow discharge, the temperature of the atmosphere being regulated by resistance heaters 45. In this sense, the glow discharge could be viewed as a "cold" plasma. Nevertheless, the glow discharge does heat the workpiece and the heat is transferred to the atmosphere where it is sensed by device 60 and resistance heaters 45 controlled by microprocessor 61 accordingly.

After a predetermined time, the power supply is shut down, thus extinguishing the plasma arc, the carburizing gas flow is discontinued and chamber 12 is pumped down until a vacuum of about 10 microns is reached while ferrous workpieces 15 are maintained at the carburizing temperature of 1650–1900 degree Fahrenheit. This "boost diffuse" condition is maintained for a predetermined time during which the penetration of the carbon into the surface case of workpieces 15 to a desired depth and degree occurs. Workpieces 15 are then rapidly transferred from vacuum chamber 12 to the quench chamber where the part is quenched typically in an oil bath under vacuum.

As discussed generally above, existing attempts to ion carburize workpieces have, for the most part, used an outside source to heat the workpiece to the carburizing temperature, sputter cleaned the workpiece, metered a carburizing gas mixed with the carrier gas into the chamber and applied as high a power as possible to the power supply to generate a glow discharge without arcing. In one sense, a number of arc detect circuits are used to sense uncontrolled arcing and fireballing which act to decrease the power until the condition has passed whereat the power is ramped up to the prior point and then readjusted, etc. It was found that the utilization of such schemes to control power supply 22 of the present invention resulted in an unstable glow punctuated by fireballs and occasionally severe arcing of a nature sufficient to short circuit the entire power supply 22. Other carburizing attempts, particularly those which utilize an AC rectified pulsed power supply similar to applicant's, simply increase the power applied to the work and rely entirely on the pulsed train to prevent a short circuiting of the entire system. The inventors have determined that the conventional $I_{Max}$ control circuit is necessary to sense impending conditions prior to their reaching the stage or state of severe short circuiting of the vessel which has tendencies to destroy the power source and damage the insulator and feed-thru's on the hearth.

Figure 5:
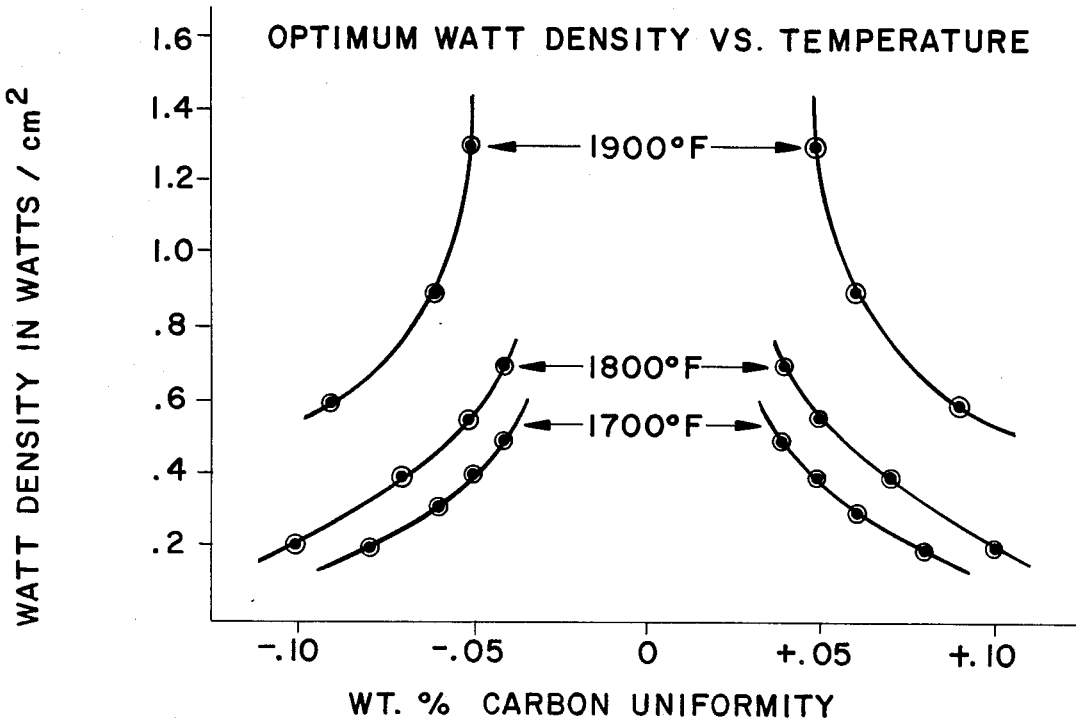
FIG. 5 is a graph illustrating optimum watt density versus percentage of carbon uniformity of the surface case.

More specifically, it has been determined that there is a maximum power or watt density factor which must be correlated with the mass flow of the carburizing gas for any given carburizing temperature to optimize the ion carburizing process. This optimization is realized with respect to (i) the time it takes to achieve a desired carbon deposit, (ii) the utilization or infusion of the deposited carbon entirely on the case to avoid sooting within the furnace thus extending the maintenance times for such furnace (typically 85% or better utilization) and most importantly, (iii) the consistency of the carbon diffused into the case of the workpiece throughout the depth of the diffusion. As best shown in FIG. 5, the power or the watt density (expressed in watts per centimeter squared of case surface area to be carburized) is established by a family of curves, each curve associated with a particular carburizing temperature whereby the uniformity of the carbon deposited on the case can be controlled within limits of ±0.1% to within ±0.03% to 0.04% provided that the mass flow of the carburizing gas (expressed as grams of carbon dispersed over the case area of the workpiece to be treated per minute) is similarly controlled for the value stated.

Figure 4:
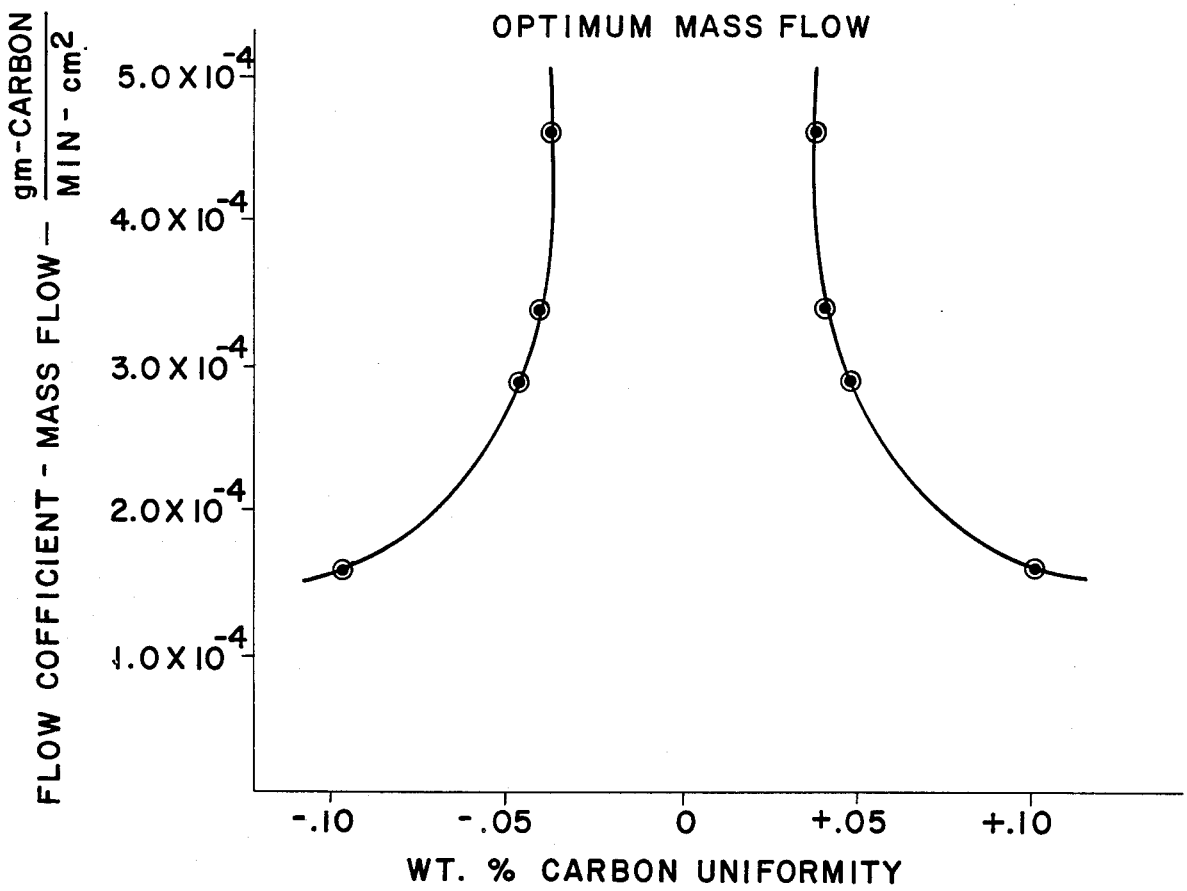
FIG. 4 is a graph illustrating the optimum mass flow of the gas versus carbon uniformity.

FIG. 4 shows the optimum carburizing gas flow expressed as a percentage of the carbon uniformity dispersed in the case of the workpiece. The mass flow of the carburizing gas is not significantly affected by temperature or pressure considerations so long as the temperature is high enough to dissociate the gas. Both FIGS. 4 and 5 are based on the use of substantially pure methane as the carburizing gas. The use of other carbon bearing gases such as propane will require adjustments to the graphs.

In actual practice and as is typical in vacuum carburizing, the case depth and surface carbon deposited is initially calculated to determine the carburize and diffuse time. Previously developed vacuum carburizing curves did not predict reliable results when applied to the ion carburizing process. Accordingly, various mathematical models were reviewed until it was determined that mathematical relationships established by F. E. Harris in 1943 for predicting carburizing boost-diffuse cycles and carbon case depth on low carbon steel could be utilized even with high alloyed steels, in the ion glow carburizing process. An article entitled "Greater Uniformity of Plasma Carburizing Rapidly" appearing in the March, 1986 issue of *Industrial Heating* by S. Verhoff, one of the inventors, explains the time for predicting the carburizing cycles utilizing Harris' relationships. Empirical factors have been developed to adjust the time for carburizing at various temperatures and a further empirical adjustment is made for ion processing when the optimized process conditions described herein are used.

Specifically, the time predicted for the cycles by the empirical adjustments to Harris' equation are correlated with the optimum watt density and mass flow of FIGS. 4 and 5. If lesser wattage or mass flows were used, the empirical adjustments to Harris' equations would change.

Another factor requiring a further adjustment to FIGS. 4 and 5 is the stacking of the workpieces within basket 13 in either a tight or loose fashion. Generally, the more loose the parts become, the higher the watt density. This could be expressed as some number related to bulk density where a single piece would be unity or one and the stacked pieces viewed as being "one piece" with spacing between workpieces reducing the value to less than one. Generally, no adjustments are made for geometrically dissimilar workpieces which are processed in one basket. There can be unusual cases where the geometrical configuration of one of the parts can result in localized heating of the workpiece causing a hollow cathode effect to exist. This, in turn, will produce uneven carbon dispersion over the workpiece. In such instance, the process is adjusted to alleviate the hollow cathode effect and the processing times adjusted accordingly.

The invention has been developed and disclosed for the carburizing process. In a broader sense, the concepts disclosed herein are believed applicable for the use of the glow discharge technique in any atmosphere which is significantly, electrically conductive. Such atmospheres are sometimes encountered in plating processes. The process would be similar. The workpiece would be heated externally and the work sputtered clean. A gas carrying the metal to be deposited without any or very little carrier or inert gas would be injected into the chamber. The process would then be controlled by the power which would be regulated as a function of temperature and coating uniformity and the mass flow of the "coating" gas would also be regulated in accordance with the desired coating uniformity to arrive at an optimum process time.

It is thus an essential feature of our invention to provide an improved ion process specifically applicable to heat treat processes by optimizing the power imparted in the glow discharge process to the workpiece correlated to the process temperature and correlated to the uniformity of the deposited material while also controlling the mass flow of the gas containing the deposited material to a value correlated to the uniformity of the deposited material.

Having thus described the invention, it is now claimed:

1. A process controlling the case carburizing of a ferrous workpiece under a vaccum in a chamber by the ion discharge of a carbon bearing gas comprising:

(a) heating said workpiece by heating means independent of the operation of the flow discharge to a carburizing temperature whereat carburizing can occur and maintaining said temperature within said chamber principally by said heating means through the completion of step (e);

(b) applying a DC current pulsed at constant periodically repeating intervals at a predetermined voltage between said workpiece as a cathode and said chamber as an anode in the presence of non-carbon bearing, ionizable gas at a predetermined vacuum to clean said workpiece;

(c) reducing said DC pulsed current to a lower value while said non-carbon bearing gas is evacuated from said chamber and a gas consisting essentially of a carbon bearing gas is continuously introduced into said chamber through step (e);

(d) after said non-carbon bearing gas has been substantially evacuated from said chamber in step c, increasing said voltage and said pulsed current to a predetermined wattage value correlated to the surface area of said workpiece to define a watt density power; and (e) simultaneously controlling said watt density power at said carburizing temperature and the continuous mass flow of said carbon bearing gas to establish a uniform carbon gradient profile within the case of said workpiece.

2. The process of claim 1 wherein step (e) controls the uniformity of the carbon gradient profile established in the case of said ferrous workpieces in the range of ±0.1% to within ±0.03%.

3. The process of claim 1 wherein said flow of carbon bearing gas is controlled according to the uniformity of the desired carbon gradient profile.

4. The process of claim 1 further including the step:

(f) boost diffusing said workpiece by stopping said external heat and wattage applied to said workpiece, increasing the vacuum applied to said chamber and holding said workpiece in said chamber under said increased vacuum for a predetermined period of time to permit said carbon to diffuse into said case of said workpiece.

5. The process of claim 4 further including the step of quenching said ferrous parts under a vacuum after said boost diffusing step has been completed.

6. The process of claim 1 further including admitting said carbon bearing gas into said chamber at a constant rate of flow.

7. The process of claim 6 wherein said constant flow step is achieved by metering the vacuum pressure applied to said chamber.

8. The process of claim 1 wherein said temperature of said atmosphere within said chamber only is sensed and controlled whereby said temperature of said workpiece is indirectly controlled said atmosphere heated principally by said external heating means, said watt density power not significantly raising said temperature of said workpiece without also raising said temperature of said atmosphere.

9. The process of claim 1 further including the step of interrupting said DC pulsed current only when said current exceeds a predetermined value and reapplying said current when said current drops below said value.

10. The process of claim 9 wherein said flow of gas is independently determined apart from other parameters related to said process.

11. The process of claim 1 wherein a plurality of workpieces is provided in a basket.

12. The process of claim 1 wherein said wattage applied in said cleaning step is slightly higher than that applied in said carburizing step.

13. The process of claim 1 wherein said carbon bearing gas is methane.

* * * * *